US012426631B2

(12) United States Patent
Jang et al.

(10) Patent No.: US 12,426,631 B2
(45) Date of Patent: Sep. 30, 2025

(54) WICK-HEATER ASSEMBLY AND AEROSOL-GENERATING DEVICE COMPRISING THE SAME

(71) Applicant: KT&G CORPORATION, Daejeon (KR)

(72) Inventors: Chul Ho Jang, Daejeon (KR); Gyoung Min Go, Daejeon (KR); Hyung Jin Bae, Daejeon (KR); Jang Won Seo, Daejeon (KR); Min Seok Jeong, Daejeon (KR); Jong Seong Jeong, Daejeon (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 17/919,436

(22) PCT Filed: Jun. 30, 2022

(86) PCT No.: PCT/KR2022/009394

§ 371 (c)(1),
(2) Date: Oct. 17, 2022

(87) PCT Pub. No.: WO2023/008756

PCT Pub. Date: Feb. 2, 2023

(65) Prior Publication Data

US 2024/0292892 A1 Sep. 5, 2024

(30) Foreign Application Priority Data

Jul. 28, 2021 (KR) ..... 10-2021-0099323

(51) Int. Cl.

| | |
|---|---|
| ***A24F 40/10*** | (2020.01) |
| ***A24F 40/44*** | (2020.01) |
| ***A24F 40/46*** | (2020.01) |

(52) U.S. Cl.
CPC ..... *A24F 40/44* (2020.01); *A24F 40/10* (2020.01); *A24F 40/46* (2020.01)

(58) Field of Classification Search
CPC ..... A24F 40/10; A24F 40/44; A24F 40/46; H05B 2203/021; H05B 2203/003; H05B 3/04; H05B 3/265; H05B 3/283
See application file for complete search history.

(56) References Cited

U.S. PATENT DOCUMENTS

| | | | |
|---|---|---|---|
| 6,598,607 | B2 | 7/2003 | Adiga et al. |
| 10,314,335 | B2 | 6/2019 | Reevell |

(Continued)

FOREIGN PATENT DOCUMENTS

| | | | |
|---|---|---|---|
| KR | 10-1690389 | B1 | 12/2016 |
| KR | 10-2019-0120310 | A | 10/2019 |

(Continued)

OTHER PUBLICATIONS

Extended European Search Report dated Sep. 15, 2023, issued in European Application No. 22777938.6.

*Primary Examiner* — Abdullah A Riyami
*Assistant Examiner* — Thang H Nguyen
(74) *Attorney, Agent, or Firm* — Sughrue Mion, PLLC

(57) ABSTRACT

The present invention relates to a wick-heater assembly comprising a porous wick for absorbing a liquid aerosol-generating substrate, wherein the porous wick comprises a plurality of porous beads; and a heater for heating the absorbed liquid aerosol-generating substrate to generate an aerosol, wherein the heater is located embedded in one side of the porous wick or in the porous wick, and comprises a flat heating pattern in which a horizontal pattern and a vertical pattern are alternately repeated and connected, and wherein the spacing (A) between the vertical patterns in the heating pattern is greater than the diameter (B) of the porous (Continued)

(a)

(b)

bead; and an aerosol-generating device comprising the same.

6 Claims, 5 Drawing Sheets

(56) References Cited

U.S. PATENT DOCUMENTS

| | | | | |
|---|---|---|---|---|
| 2014/0238424 | A1* | 8/2014 | Macko | A24F 40/44 131/328 |
| 2017/0108210 | A1* | 4/2017 | Meinhart | B05B 7/1686 |
| 2018/0015385 | A1* | 1/2018 | Meinhart | H05B 3/02 |
| 2018/0177240 | A1 | 6/2018 | Duque et al. | |
| 2020/0352238 | A1 | 11/2020 | Simpson et al. | |
| 2021/0084982 | A1 | 3/2021 | Yilmaz et al. | |
| 2021/0186105 | A1 | 6/2021 | Thorens et al. | |
| 2021/0370296 | A1* | 12/2021 | Handique | C12Q 1/6806 |
| 2022/0104548 | A1* | 4/2022 | Rosser | A24F 40/10 |
| 2022/0295889 | A1 | 9/2022 | Zinovik | |

FOREIGN PATENT DOCUMENTS

| | | | | |
|---|---|---|---|---|
| KR | 10-2021-0011827 | A | 2/2021 | |
| WO | 2018/125934 | A1 | 7/2018 | |
| WO | WO-2020157506 | A1 * | 8/2020 | A24F 40/10 |
| WO | 2020/259973 | A1 | 12/2020 | |

* cited by examiner

【Figure 1】
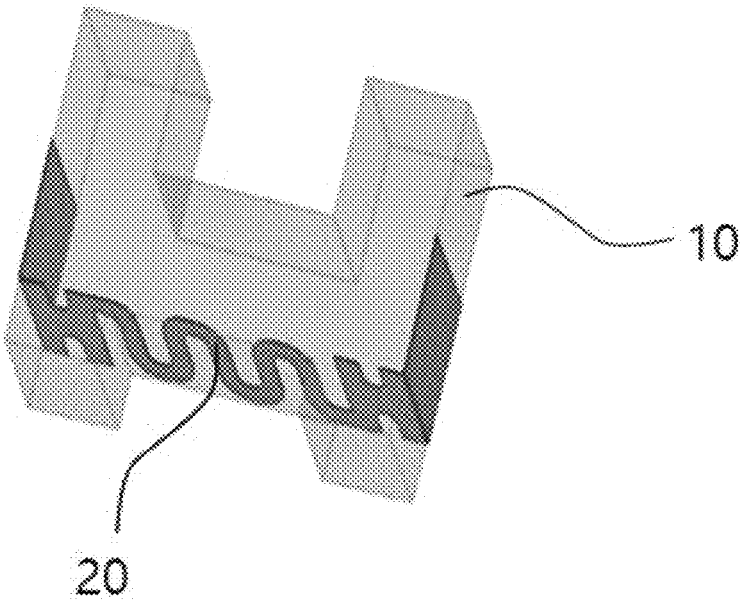
【Figure 2】
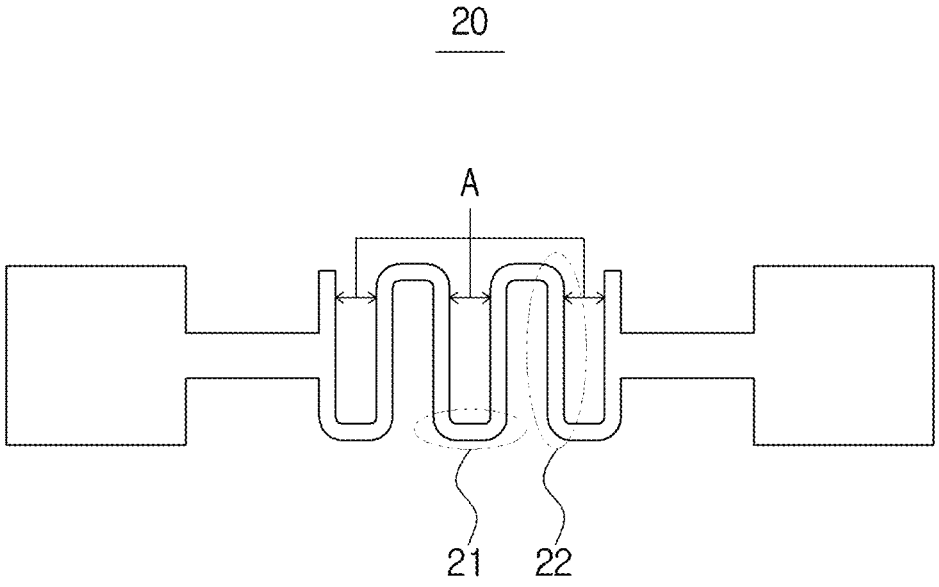

【Figure 3】
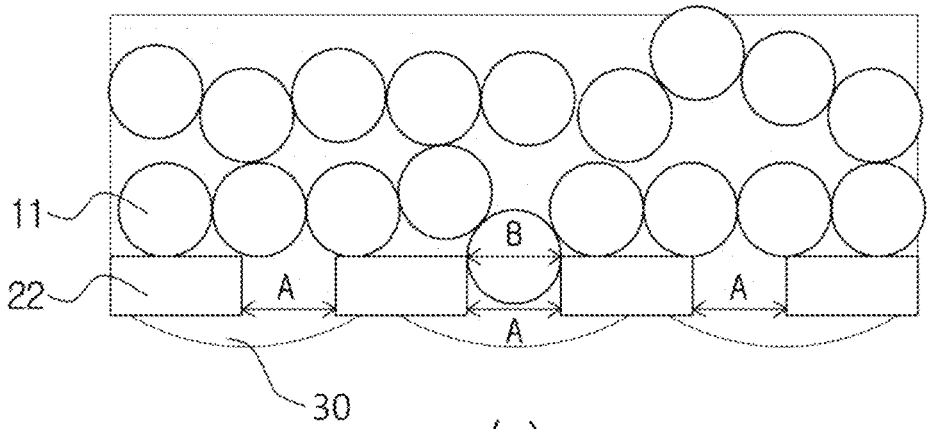
(a)
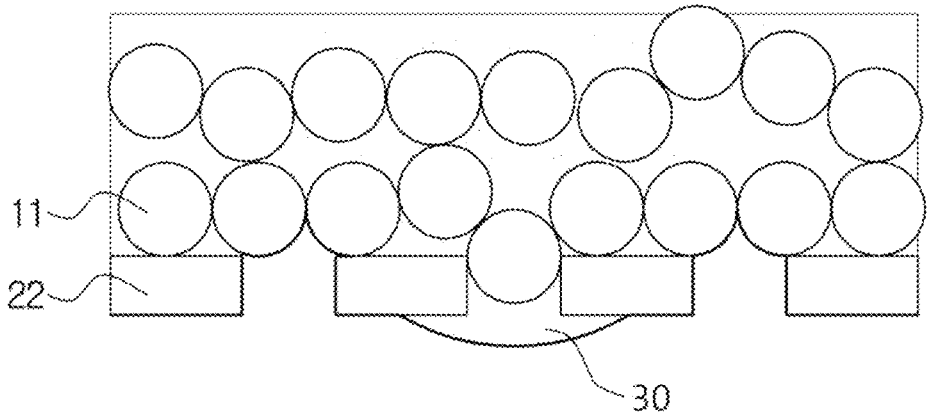
(b)

【Figure 4】
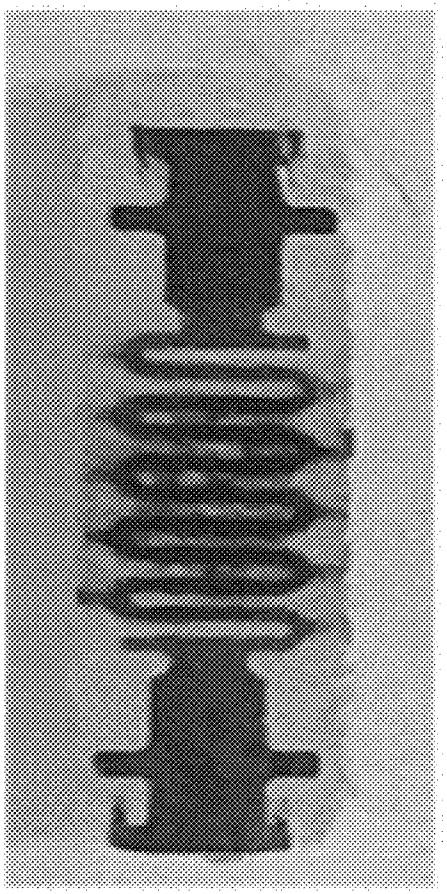

【Figure 5】
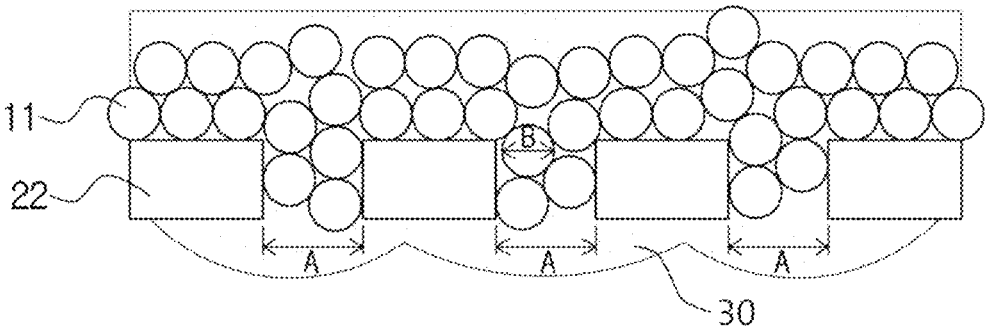
(a)
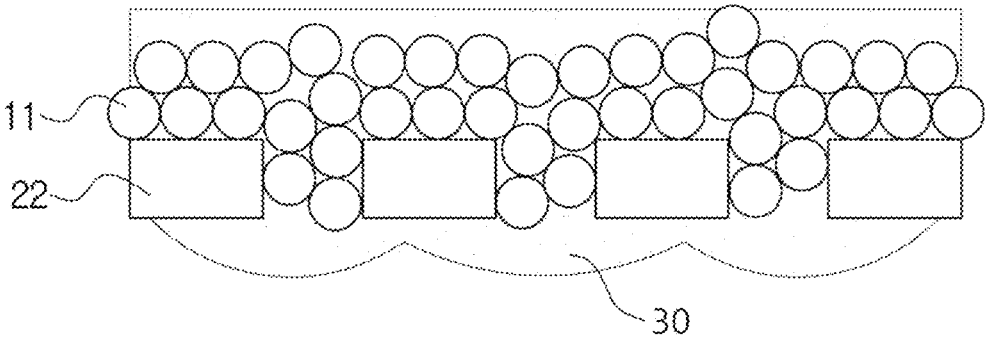
(b)

【Figure 6】
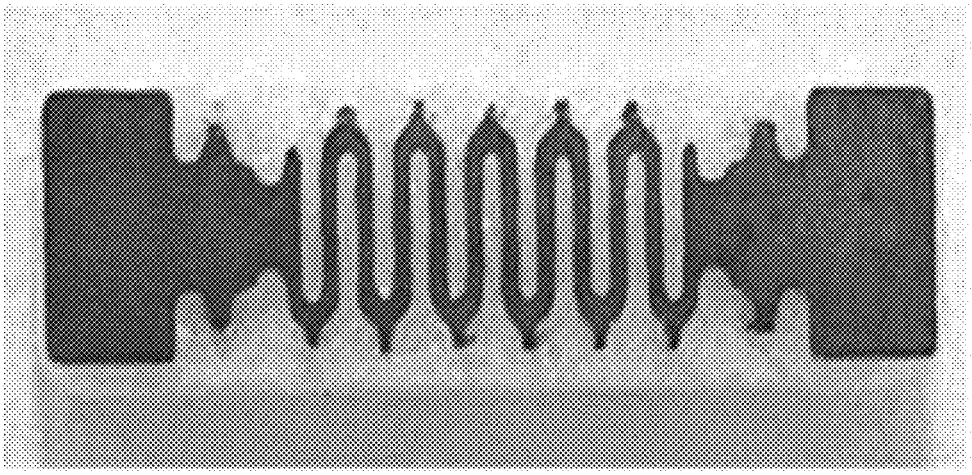

WICK-HEATER ASSEMBLY AND AEROSOL-GENERATING DEVICE COMPRISING THE SAME

CROSS REFERENCE TO RELATED APPLICATIONS

This application is a National Stage of International Application No. PCT/KR2022/009394 filed Jun. 30, 2022, claiming priority based on Korean Patent Application No. 10-2021-0099323 filed Jul. 28, 2021.

TECHNICAL FIELD

The present invention relates to a wick-heater assembly and an aerosol-generating device comprising the same.

This application claims the benefit of priority based on Korean Patent Application No. 10-2021-0099323 filed on Jul. 28, 2021, the entire contents of which are incorporated herein as part of the present specification.

BACKGROUND ART

In recent years, there is an increasing demand for alternative smoking articles to overcome the general disadvantages of cigarettes. For example, there is an increasing demand for a device for generating an aerosol by heating a liquid aerosol-generating substrate, rather than a method of generating an aerosol by burning conventional cigarettes, and researches on this are being actively conducted.

The aerosol-generating device using a method of heating a liquid aerosol-generating substrate comprises a wick-heater assembly in which a wick for absorbing the liquid aerosol-generating substrate and a heater for heating the liquid are combined. In a method of coupling a heater on a wick to manufacture the wick-heater assembly, an in-mold method of embedding the heater inside the wick and a method of denting the heater only as much as the thickness of the heater inward on the surface of the wick may be used.

When the heater is dented by its thickness on the wick surface as described above, there are advantages in that the production cost of the wick-heater assembly is relatively reduced, and the amount of aerosol generated is increased compared to the in-mold method, but there are problems in that as one side of the patterned heater is exposed to the outside without being dented and is in the liquid aerosol-generating direct contact with air, if substrate does not move smoothly to that heater surface, the abnormal overheating phenomenon occurs partially in the heater, resulting in the occurrence of burnt taste.

Specifically, when a porous bead is used as the wick, the porous beads are inserted into the space between the heating patterns of the heater to form voids, and the liquid aerosol-generating substrate may be moved from the porous wick to one surface of the heater in contact with air through this path. In this case, since it takes a certain time for the liquid aerosol-generating substrate to move again from the porous wick to the air contact surface of the heater after heating, if heating is started in a state in which the liquid aerosol-generating substrate is in contact with air before it arrives, the cooling effect due to the heat of vaporization cannot be expected, and thus, problems have been pointed out that the liquid carbonization phenomenon and burnt taste occur due to the abnormal overheating phenomenon of 300 degrees or more in a part of the heater.

Therefore, in a wick-heater assembly comprising a heater having a heating pattern, there is a need for research to solve the problem that the liquid aerosol-generating substrate does not smoothly move to the heater surface in contact with external air.

PRIOR ART DOCUMENT

Patent Documents (Patent Document 1) Korean Patent No. 10-1690389, entitled "An electrically heated smoking system having a liquid storage portion"

DISCLOSURE

Technical Problem

In order to solve the above-mentioned problems, the present inventors intend to provide a wick-heater assembly capable of preventing the abnormal overheating phenomenon and the occurrence of burnt t taste by the smooth movement of a liquid aerosol-generating substrate, and an aerosol-generating device comprising the same, by designing a wick-heater assembly in consideration of the relationship between the size of the porous bead included in the porous wick and the spacing between heating patterns of the heater.

Technical Solution

According to a first aspect of the present invention, there is provided a wick-heater assembly comprising a porous wick for absorbing a liquid aerosol-generating substrate, wherein the porous wick comprises a plurality of porous beads; and a heater for heating the absorbed liquid aerosol-generating substrate to generate an aerosol, wherein the heater is located embedded in one side of the porous wick or in the porous wick, and comprises a flat heating pattern in which a horizontal pattern and a vertical pattern are alternately repeated and connected, and wherein the spacing (A) between the vertical patterns in the heating pattern is greater than the diameter (B) of the porous bead.

In one embodiment of the present invention, it may have a structure in which the porous beads are inserted into the space between the vertical patterns.

In one embodiment of the present invention, it may have a structure having voids between the plurality of porous beads and between the vertical pattern and the inserted porous beads, for the movement of the liquid aerosol-generating substrate.

In one embodiment of the present invention, the heating pattern may have a structure connected while maintaining parallel between vertical patterns a horizontal pattern as a connection part, and the spacing between the vertical patterns may be constant.

In one embodiment of the present invention, the ratio (A/B) of the spacing (A) between the vertical patterns to the diameter (B) of the porous beads may exceed 1.1 and 20 or less.

In one embodiment of the present invention, the ratio (A/B) of the spacing (A) between the vertical patterns to the diameter (B) of the porous beads may exceed 1.5 and 10 or less.

In one embodiment of the present invention, the heater may be a heating pattern located embedded at a depth of 400 μm or less in an inward direction from one surface of the porous wick.

According to a second aspect of the present invention, there is provided an aerosol-generating device comprising a liquid storage part for storing a liquid aerosol-generating substrate; an aerosol-generating part for heating the aerosol-generating substrate to generate an aerosol; and a mouthpiece for discharging the generated aerosol according to the user's puff, wherein the aerosol-generating part comprises the wick-heater assembly.

Advantageous Effects

By designing a wick-heater assembly in consideration of the relationship between the spacing between heating patterns and the size of the porous bead, the wick-heater assembly and the aerosol-generating device comprising the same according to the present invention have the effect of preventing an abnormal overheating phenomenon in which a portion of the heater is excessively heated at an instant and the occurrence of burnt taste resulting therefrom, because the liquid aerosol-generating substrate smoothly moves to the heating pattern surface in contact with air through the capillary phenomenon of the wick even after the liquid aerosol-generating substrate is vaporized by heating of the heater.

DESCRIPTION OF DRAWINGS

FIG. 1 shows a schematic view of the wick-heater assembly of the present invention.

FIG. 2 shows a schematic view of a heater included in the wick-heater assembly of the present invention.

FIG. 3 shows schematic views of the movement of a liquid aerosol-generating substrate in (a) an initial state before heating a heater and (b) a state after heating the heater, in a conventional wick-heater assembly.

FIG. 4 shows a photograph of a liquid carbonization phenomenon occurring after generating an aerosol using a conventional wick-heater assembly.

FIG. 5 shows schematic views of the movement of a liquid aerosol-generating substrate in (a) an initial state before heating a heater and (b) a state after heating the heater in the wick-heater assembly of the present invention.

FIG. 6 shows a photograph of the wick-heater assembly after generating an aerosol using the wick-heater assembly of the present invention.

BEST MODE

The terms and words as used in the present specification and claims should not be construed as limited to conventional or dictionary meanings, but should be construed as the meaning and concept consistent with the technical idea of the present invention based on the principle that the inventor can appropriately define the concept of the term to describe its own invention in the best way. Accordingly, the embodiments described in the present specification and the configurations shown in the drawings are only the most preferred embodiment of the present invention and do not represent all of the technical spirit of the present invention, and thus it should be understood that various equivalents and modifications may be substituted for them at the time of filing the present application.

In the drawings, the size of each component or a specific part constituting the component is exaggerated, omitted, or schematically illustrated for convenience and clarity of description. Thus, the size of each component does not fully reflect the actual size. If it is determined that the specific description of the related known functions or constitutions may unnecessarily obscure the gist of the present invention, the description thereof will be omitted.

In the wick-heater assembly, it takes a certain time for the liquid aerosol-generating substrate to be transferred again to the pattern form surface of the heater in contact with air through the capillary phenomenon of the porous wick after heating the heater to generate an aerosol. However, when heating is started again in a state in which the liquid aerosol-generating substrate does not reach the pattern form surface, there was a problem in that the heater locally overheats without a cooling effect due to the heat of vaporization, which causes liquid to burn.

In order to solve the above-mentioned problems, the present inventors have provided the wick-heater assembly of the present invention and an aerosol-generating substrate comprising the same, which does not cause the abnormal overheating or carbonization phenomenon by allowing the liquid aerosol-generating substrate absorbed through the capillary phenomenon of the porous wick to be smoothly transferred to the pattern form surface in contact with air when designing the wick-heater assembly, as a result of studying the relationship between the spacing between the vertical patterns of the heater and the size of the porous bead.

Hereinafter, the present invention will be described in detail with reference to the accompanying drawings.

In the present specification, an "aerosol-generating substrate" is defined as a material capable of generating an aerosol. The aerosol-generating substrate may be a liquid composition, and specifically may include, but is not particularly limited to, a liquid composition based on nicotine, tobacco extract and/or various flavoring agents. In an embodiment, the aerosol-generating substrate may include at least one of propylene glycol and glycerin, and may further include at least one of ethylene glycol, dipropylene glycol, diethylene glycol, triethylene glycol, tetraethylene glycol, and oleyl alcohol. The aerosol-generating substrate may further include various additives such as cinnamon and capsaicin. The aerosol-generating substrate may include a material in the form of a gel or a solid as well as a liquid material having high fluidity, and the compositional components included in the substrate may vary depending on embodiments and are not limited to a specific ratio.

In the present specification, an "aerosol-generating device" is defined as a device that generates an aerosol using an aerosol-generating substrate for generating an aerosol that may be directly inhaled into the user's lungs through the user's mouth. For example, the aerosol-generating device may include, but is not particularly limited to, a liquid-type aerosol-generating device, a hybrid aerosol-generating device using a vaporizer and a cigarette together, and may further include various types of aerosol-generating devices.

The present invention provides a wick-heater assembly comprising a porous wick 10 for absorbing a liquid aerosol-generating substrate 30, wherein the porous wick 10 comprises a plurality of porous beads 11; and a heater 20 for heating the absorbed liquid aerosol-generating substrate 30 to generate an aerosol, wherein the heater 20 is located embedded in one side of the porous wick or in the porous wick, and comprises a flat heating pattern in which a horizontal pattern 21 and a vertical pattern 22 are alternately repeated and connected, and wherein the spacing (A) between the vertical patterns 22 in the heating pattern is greater than the diameter (B) of the porous bead 11.

The wick-heater assembly comprises a porous wick 10 for absorbing a liquid aerosol-generating substrate 30. The porous wick 10 may be configured to serve to absorb the liquid aerosol-generating substrate 30 from a liquid storage part and transfer it to the heater 20, which heats it to generate an aerosol.

The porous wick 10 is a structure comprising a plurality of beads and, for example, may be, but is not particularly limited to, a body-centered cubic (BCC) or a face-centered cubic (FCC) sphere packing structure, and may have various packing structures. The shape of the porous wick 10 is not particularly limited as long as it can easily absorb the liquid aerosol-generating substrate 30 from the liquid storage part, and may be designed and implemented in various shapes such as, for example, an H-like shape, a ∩-like shape, or a ∪-like shape.

The porous wick 10 comprises a plurality of porous beads 11. The material of the porous bead 11 may be various and, for example, may include a glass bead, a ceramic bead, or an alumina bead, but it is not particularly limited thereto as long as it is a bead of a material capable of smoothly transferring the liquid aerosol-generating substrate 30 as a porous material.

The wick-heater assembly comprises a heater 20 for heating the absorbed liquid aerosol-generating substrate 30 to generate an aerosol. The heater 20 may be configured to serve to generate an aerosol by vaporizing the liquid aerosol-generating substrate 30 transferred from the porous wick 10 by heating.

As shown in FIGS. 1 and 2, the heater 20 is located embedded in one side of the porous wick 10 or in the porous wick 10, and comprises a flat heating pattern in which a horizontal pattern 21 and a vertical pattern 22 are alternately repeated and connected, In the present specification, a "one surface" of the porous wick may be defined as an area formed by continuously connecting the porous beads exposed to the outside and located at the outermost side of the porous wick, and may include both flat and curved surfaces.

In the present specification, a "horizontal pattern" is defined as a pattern disposed in the direction of a long edge on one surface of the porous wick in which the heater is located, or on one surface of the porous wick in which the heater is located embedded, and a "vertical pattern" is, on the contrary, defined as a pattern disposed in the direction of a short edge on one surface of the porous wick in which the heater is located, or on one surface of the porous wick in which the heater is located embedded.

The heating pattern may have a structure connected while maintaining parallel between the vertical patterns 22 using the horizontal pattern 21 as a connection part. Specifically, as shown in FIG. 2, terminals are positioned at both ends of the heater; a heating pattern repeatedly connected in the order of the vertical pattern 22—the horizontal pattern 21—the vertical pattern 22—the horizontal pattern 21 may be positioned between both terminals; and a structure in which the horizontal patterns 21 are connected at the end of each vertical pattern 22 and the vertical patterns 22 are connected at the end of each horizontal pattern 21 may be repeated. Through the structure of the heater 20 in which the horizontal pattern 21 and the vertical pattern 22 are repeated, the spacing may be formed between the vertical patterns 22, and the liquid aerosol-generating substrate 30 absorbed through the porous wick 10 may be transferred to a heater surface in contact with air or a heater surface facing outward through the spacing to generate an aerosol during heating.

The spacing (A) between the vertical patterns 22 in the heating pattern is greater than the diameter (B) of the porous bead 11. As shown in FIG. 5, when the spacing (A) between the vertical patterns 22 in the heating pattern is greater than the diameter (B) of the porous bead 11, it may have a structure in which the porous beads 11 are inserted into the space between the vertical patterns 22. Due to the insertion of the porous beads 11, voids in which the liquid aerosol-generating substrate 30 may move may be formed in the space between the vertical patterns 22.

For the movement of the liquid aerosol-generating substrate 30, the wick-heater assembly may have a structure having voids between the plurality of porous beads 11 and between the vertical pattern 22 and the inserted porous beads 11. A void is formed between the inserted porous beads 11 or between the vertical pattern 22 and the inserted porous bead 11, through which the liquid aerosol-generating substrate 30 may move through the capillary phenomenon to be transferred to the heater surface in contact with air or to the heater surface facing outward.

Specifically, when the spacing (A) between the vertical patterns 22 in the heating pattern is greater than the diameter (B) of the porous beads 11, the porous beads 11 are easily inserted into the space formed between the vertical patterns 22 as shown in FIG. 5B as well as in the initial state before heating of the heater 20 as shown in FIG. 5A to form a void, through which the liquid may be smoothly transferred without empty space, and the liquid is transferred without any particular interfering factor even through the path between the vertical patterns 22, and thus, an aerosol may be generated in a state in which the pattern form surface of the heater is all surrounded by the liquid aerosol-generating substrate 30 so that it does not come into contact with external air when the heater 20 is heated. As a result, there is an effect that may prevent problems such as the occurrence of burnt taste according to the abnormal overheating phenomenon or the liquid carbonization phenomenon by the cooling effect due to the vaporization of the liquid aerosol-generating substrate 30.

On the other hand, when the spacing (A) between the vertical patterns 22 in the heating pattern is equal to or smaller than the diameter (B) of the porous beads 11, the porous beads 11 are difficult to be inserted into the space formed between the vertical patterns 22, the porous beads 11 having a large diameter may interfere with the transport through the path between the vertical patterns 22, and formation of voids for smooth transport of liquids may also be difficult.

Specifically, even though it is in the initial state in which the liquid aerosol-generating substrate 30 surrounds all of the heater so that the pattern form surface of the heater does not come into contact with external air before the heating of the heater 20, as shown in FIG. 3A, the liquid may be difficult to be smoothly transferred through the path between the vertical patterns 22 of the heater by the interference of the porous beads 11 having a diameter greater than the spacing of the patterns after heating the heater 30 to generate an aerosol as shown in FIG. 3B, and thus, the heater is heated in a state in which the pattern form surface of the heater is in contact with air, which may cause the abnormal overheating and liquid carbonization phenomenon.

The spacing between the vertical patterns 22 of the wick-heater assembly may be constant. In consideration of the diameter size of the porous bead 11 when manufacturing the wick-heater assembly, the spacing between the vertical patterns 22 may be designed to have a constant spacing sufficient to prevent the localized abnormal overheating or carbonization phenomenon of the heater 20 by smoothly transferring the liquid aerosol-generating substrate 30.

The ratio (A/B) of the spacing (A) between the vertical patterns 22 to the diameter (B) of the porous bead 11 may exceed 1.1, exceed 1.2, exceed 1.3, exceed 1.4, exceed 1.5, exceed 1.6, exceed 1.7, exceed 1.8, exceed 1.9, exceed 2, exceed 3, exceed 4, exceed 5, exceed 6, exceed 7, exceed 8, or exceed 9, and the ratio (A/B) of the spacing (A) between the vertical patterns 22 to the diameter (B) of the porous bead 11 may be 20 or less, 19 or less, 18 or less, 17 or less, 16 or less, 15 or less, 14 or less, 13 or less, 12 or less, 11 or less, 10 or less, 9 or less, 8 or less, 7 or less, 6 or less, 5 or less, 4 or less, 3 or less, or 2 or less. When the ratio (A/B) of the spacing (A) between the vertical patterns (22) to the diameter (B) of the porous bead (11) is 1.1 or less, the porous beads 11 are not easy to be uniformly inserted into the space between the vertical patterns 22, and even if the porous beads 11 are inserted, the volume of the voids that may be formed between the vertical patterns 22 is relatively small, so that it may be difficult for the liquid aerosol-generating substrate 30 to pass between the patterns and reach the pattern surface in contact with air. In addition, when the ratio (A/B) is 1.1 or less, a plurality of porous beads 11 are piled up in a large amount on the upper side of the inserted porous beads 11 and act as a factor that further interfere with the path through which the liquid aerosol-generating substrate 30 can move, so that it is difficult for the liquid to reach the pattern surface of the heater 20, and a burning phenomenon of the liquid may occur due to local overheating. When the ratio (A/B) of the spacing (A) between the vertical patterns 22 to the diameter (B) of the porous bead 11 exceeds 20, as the spacing between the patterns of the heater becomes too far compared to the size of the beads size and the path of the heater itself becomes shorter, the power density increases and the amount of heat increases, and in this case, although smooth supply of the liquid is required, the liquid supply through the wick is not smooth since the diameter of the porous beads is relatively small, which may cause the liquid to burn due to local overheating.

The heater 20 may be a heating pattern located embedded in a depth of 400 μm or less, 350 μm or less, 300 μm or less, 250 μm or less, 200 μm or less, 150 μm or less, 100 μm or less, or 50 μm or less in an inward direction from one surface of the porous wick 10. When the heating pattern is embedded in a depth exceeding 400 μm in an inward direction from one surface of the porous wick 10, it is not easy to increase the temperature of the entire porous wick to a certain temperature due to an increase in the amount of heat required to heat the periphery of the porous wick 10, and thus, the amount of aerosol generated may be reduced.

The aerosol-generating device comprises a liquid storage part for storing a liquid aerosol-generating substrate 30; an aerosol-generating part for heating the aerosol-generating substrate 30 to generate an aerosol; and a mouthpiece for discharging the generated aerosol according to the user's puff, wherein the aerosol-generating part comprises the wick-heater assembly.

The aerosol-generating device comprises a liquid storage part for storing a liquid aerosol-generating substrate 30. The liquid storage part may have a predetermined space to store a liquid aerosol-generating substrate 30 therein, and store the liquid aerosol-generating substrate 30 in the space. The liquid storage part may supply the stored liquid aerosol-generating substrate 30 to the heater 20 through the porous wick 10, and store the liquid aerosol-generating substrate 30 therein, and is not particularly limited in size and shape as long as it can store the liquid aerosol-generating substrate 40 therein and easily supply it to the porous wick 10.

The aerosol-generating device comprises an aerosol-generating part for heating the aerosol-generating substrate 30 to generate an aerosol. The aerosol-generating part comprises the wick-heater assembly. Specific description of the wick-heater assembly is the same as described above.

The aerosol-generating device comprises a mouthpiece for discharging the generated aerosol according to the user's puff, The mouthpiece may be a part in direct contact with the user's mouth in order to puff the aerosol generated from the aerosol-generating part. The mouthpiece may comprise an antibacterial material to suppress the generation of microorganisms due to contact with the mouth, and may comprise a flavoring element to add flavor. The mouthpiece is not particularly limited in size and shape as long as the aerosol generated through the aerosol-generating part can be easily delivered to the user.

MODE FOR CARRYING OUT THE INVENTION

Hereinafter, preferred examples will be presented to help the understanding of the present invention, but the following examples are provided not to limit the present invention but to better understand the present invention.

Examples 1 and 2: Preparation of Aerosol-Generating Devices

Example 1

Glass beads (diameter: 145 μm) were mixed with a binder and fired to prepare a porous wick. A wick-heater assembly was manufactured by combining a heater comprising a heating pattern in which a horizontal pattern and a vertical pattern were repeated and connected on the lower surface of the porous wick. In this case, the spacing between the vertical patterns of the heater was constant at 180 μm.

The wick-heater assembly was combined with a cartridge comprising a liquid aerosol-generating substrate and then coupled to a body supporting the same to manufacture an aerosol-generating device.

Example 2

An aerosol-generating device was manufactured in the same manner as in Example 1, except that glass beads having a diameter of 115 μm and a heater having a spacing between vertical patterns of 210 μm were used in manufacturing the wick-heater assembly.

Experimental Example 1: Measurement of Formaldehyde Emissions

An aerosol was generated using the aerosol-generating devices prepared in Examples 1 and 2 above, and then emissions (μg/100 $cm^3$) of formaldehyde contained in the aerosol were measured using a formaldehyde measuring device (LC/UV, Waters), and the results are shown in Table 1 below.

TABLE 1

| | A (spacing between vertical patterns within a heating pattern) (μm) | B (diameter of porous bead) (μm) | A/B | Formaldehyde emissions (μg/100 $cm^3$) |
|---|---|---|---|---|
| Example 1 | 180 | 145 | 1.24 | 4.84 |
| Example 2 | 210 | 115 | 1.83 | 0.24 |

Through the results of Table 1, based on maximum exposure limit (MEL) of 5.5 μg/100 $cm^3$, which is the limit point at which the maximum exposure to formaldehyde is acceptable, it was confirmed that the aerosols generated through Examples 1 and 2 were within the range in which formaldehyde emissions are acceptable.

Although the present invention has been described above with reference to limited examples and drawings, the present invention is not limited thereto, and it will be apparent that various modifications and variations may be made within the scope of the technical spirit of the present invention and equivalents of the claims to be described below by those skilled in the art to which the present invention pertains.

DESCRIPTION OF SYMBOLS

10: Porous wick
11: Porous bead
20: Heater
21: Horizontal pattern
22: Vertical pattern
30: Liquid aerosol-generating substrate
A: Spacing between vertical patterns
B: Diameter of the porous bead

The invention claimed is:

1. A wick-heater assembly comprising:

a porous wick for absorbing a liquid aerosol-generating substrate, wherein the porous wick comprises a plurality of porous beads; and a heater for heating the absorbed liquid aerosol-generating substrate to generate an aerosol, wherein the heater is located embedded in one side of the porous wick or in the porous wick, and comprises a flat heating pattern in which a horizontal pattern and a vertical pattern are alternately repeated and connected, and wherein the spacing (A) between the vertical patterns in the heating pattern is greater than the diameter (B) of the porous bead, wherein the plurality of porous beads are inserted into a space between the vertical patterns, and wherein voids are formed between the plurality of porous beads and between the vertical pattern and the inserted porous beads, for a movement of the liquid aerosol-generating substrate.

2. The wick-heater assembly according to claim 1, wherein the flat heating pattern has a structure connected while maintaining parallel between vertical patterns using a horizontal pattern as a connection part, and the spacing between the vertical patterns is constant.

3. The wick-heater assembly according to claim 1, wherein a ratio (A/B) of the spacing (A) between the vertical patterns to the diameter (B) of the plurality of porous beads is greater than 1.1 and less than or equal to 20.

4. The wick-heater assembly according to claim 1, wherein a ratio (A/B) of the spacing (A) between the vertical patterns to the diameter (B) of the plurality of porous beads is greater than 1.5 and less than or equal to 10.

5. The wick-heater assembly according to claim 1, wherein the heater is a heating pattern located embedded at a depth of 400 μm or less in an inward direction from one surface of the porous wick.

6. An aerosol-generating device comprising:

a liquid storage part for storing a liquid aerosol-generating substrate;

an aerosol-generating part for heating the aerosol-generating substrate to generate an aerosol; and a mouthpiece for discharging the generated aerosol according to a user's puff, wherein the aerosol-generating part comprises the wick-heater assembly according to claim 1.

* * * * *